US007252023B1

(12) United States Patent
Perry et al.

(10) Patent No.: US 7,252,023 B1
(45) Date of Patent: Aug. 7, 2007

(54) LOCKING PLIERS FOR DETACHABLY LOCKINGLY CAPTURING A CHAIN THERETO

(76) Inventors: Christopher Bruce Perry, Route 2 Box 96, Battleboro, NC (US) 27809; James Christopher Rogerson, 2406 Rogerson Rd., Robersonville, NC (US) 27871

( * ) Notice: Subject to any disclaimer, the term of this patent is extended or adjusted under 35 U.S.C. 154(b) by 0 days.

(21) Appl. No.: 11/638,776

(22) Filed: Dec. 14, 2006

(51) Int. Cl.
*B25B 7/12* (2006.01)

(52) U.S. Cl. ..... 81/367; 81/342; 81/368

(58) Field of Classification Search ..... 81/342, 81/367, 368
See application file for complete search history.

(56) References Cited

U.S. PATENT DOCUMENTS 1,706,411 A * 3/1929 Pfaff ..... 81/69
2,042,137 A * 5/1936 Wilson ..... 81/68
3,657,948 A 4/1972 Myers
4,257,288 A * 3/1981 Bianco ..... 81/65.2
4,477,937 A * 10/1984 Costello ..... 7/139
5,435,214 A 7/1995 Sisson
5,609,080 A 3/1997 Flavigny
5,842,371 A 12/1998 Liaw
5,992,273 A 11/1999 Galea
6,000,304 A * 12/1999 Hegemier ..... 81/370
6,199,458 B1 3/2001 Wrigley

* cited by examiner

*Primary Examiner*—Joseph J. Hail, III
*Assistant Examiner*—Shantese McDonald

(57) ABSTRACT

An improved chain locking pliers being of the type having a fixed handle, a movable handle, a fixed jaw affixed to the fixed handle for movement therewith, a movable jaw pivotally mounted to both the movable handle and the fixed handle, and apparatus for holding a chain and being associated with detents in both the fixed jaw and the movable jaw, respectively. The improvement includes the apparatus detachably lockingly capturing the chain to the fixed jaw.

3 Claims, 2 Drawing Sheets

LOCKING PLIERS FOR DETACHABLY LOCKINGLY CAPTURING A CHAIN THERETO

1. BACKGROUND OF THE INVENTION

A. Field of the invention

The embodiments of the present invention relate to locking pliers, and more particularly, the embodiments of the present invention relate to locking pliers for detachably lockingly capturing a chain thereto.

B. Description of the prior art

Numerous innovations showing locking pliers and methods of use are shown in the prior art that will be described below, which are in chronological order to show advancement in the art, and which are incorporated herein by reference thereto. Even though these innovations may be suitable for the specific individual purposes to which they address, however, they differ from the embodiments of the present invention in that they do not teach locking pliers for detachably lockingly capturing a chain thereto.

(1) U.S. Pat. No. 3,657,948 to Myers

U.S. Pat. No. 3,657,948 issued to Myers on Apr. 25, 1972 in class 81 and subclass 367 teaches a locking plier employing the over-center locking principle. A movable jaw is pivotally connected to a rigid handle terminating in a rigid jaw and a movable handle is pivotally connected to the movable jaw. A sliding adjuster having an opening therethrough is positioned over the rigid handle and teeth along the opening mate is locking engagement with teeth along the rigid handle. A link pivotally connects the sliding adjuster and the movable handle to permit the over-center locking position when the teeth are in locking engagement.

(2) U.S. Pat. No. 5,435,214 to Sisson Jul. 25, 1995

U.S. Pat. No. 5,435,214 issued to Sisson on Jul. 25, 1995 in class 81 and subclass 376 teaches a plier-type locking wrench having an elongated body with a pair of jaws at one end and a pair of handles at an opposite end. The pair of jaws include a fixed jaw and a movable jaw. The pair of handles includes a fixed handle and a movable handle. A threaded member engages the fixed handle. An operating crank is pivotally attached to the body adjacent the fixed handle. The movable jaw is connected to the operating crank by a connecting rod. The movable handle is pivotally connected to the operating crank. A locking lever has a first end pivotally connected to the movable handle and a second end cammingly engageable with the threaded member. The movable handle is displacable relative to the fixed handle to displace the operating crank which in turn displaces the connecting rod and the movable jaw. The locking lever permits the movable jaw to be locked in a desired position relative to the fixed jaw. The threaded member is adjustable to adjust the locking position of the pivotal jaw. A release lever releases the movable jaw from its locked position.

(3) U.S. Pat. No. 5,609,080 Flavigny

U.S. Pat. No. 5,609,080 issued to Flavigny on Mar. 11, 1997 in class 81 and subclass 368 teaches locking pliers including a fixed unit of generally elongate shape forming at one end a fixed handle and at the other end a fixed jaw. A movable unit includes a movable jaw articulated to the fixed jaw and an actuating lever of which one end is articulated to the movable jaw and the other end forms a movable handle. Also, a toggle mechanism includes a link articulated to an intermediate point of the lever and extends to a rear bearing point adjustable along the length of the fixed handle. The actuating lever crosses a straight line joining the articulation of the movable jaw to the bearing point of the link and the fixed handle extends substantially along a straight line joining the articulation to the bearing point.

(4) U.S. Pat. No. 5,842,371 Liaw

U.S. Pat. No. 5,842,371 issued to Liaw on Dec. 1, 1998 in class 72 and subclass 409.12 teaches a wire crimper having a body with a fixed jaw, a lever, a movable jaw pivoted between the body and the lever, a ratchet member coupled between a body and a lever thereof, a release plate pivoted to the lever and forced by a spring into engagement with the ratchet, and an adjustment mechanism for adjusting the angular position of a ratchet member relative to the body. The adjustment mechanism includes an eccentric shaft to which the ratchet member is pivoted. A fixed stub is locating rod at the body, an adjustment wheel is axially movably supported on the eccentric shaft and adapted for turning the eccentric shaft to change the angular position of the ratchet member. A spring washer retained to the eccentric shaft and forcing the adjustment wheel into engagement, with the fixed stub locating rod to stop the adjustment wheel from rotary motion.

(5) U.S. Pat. No. 5,992,273 to Galea

U.S. Pat. No. 5,992,273 issued to Galea on Nov. 30, 1999 in class 81 and subclass 368 teaches a set of adjustable locking pliers having two pivotally mounted jaws. A lock lever is pivotally mounted to one handle member and slidably retained in the longitudinal grooved portion of the opposite handle and an adjustment screw is threaded longitudinally into the grooved handle member bears upon the sliding end of the lever. Handle members are pivotally connected to retaining plates. The plates have a pin projecting between them, with the jaws pivotally mounted and laterally disposed thereon. The gripping surfaces of the jaws interlock above the pin and meet flush in the locked position. The handle member having the adjustment screw has a curved end spreading the bottom of the jaws apart in the locked position, thereby forcing the gripping surfaces together.

(6) U.S. Pat. No. 6,000,304 to Hegemier

U.S. Pat. No. 6,000,304 issued to Hegemier on Dec. 14, 1999 in class 81 and subclass 370 teaches a chain pliers including a body and a first jaw. A component is for attaching in a stationary manner the first jaw to a top end of the body. A second jaw is provided. An element is for attaching in a pivotal manner the second jaw to the top end of the body opposite from the first jaw. A vise grip assembly is between the body and the second jaw. A person can operate with one hand the vise grip assembly and move the second jaw towards the first jaw to engage with opposite ends of a chain to tighten the chain.

Specifically, as shown in FIG. 1, which is diagrammatic perspective view of a typical prior art chain locking pliers, the typical prior art chain locking pliers is shown generally at 10 and is of the type having a fixed handle 12, a movable handle 14, a fixed jaw 16 affixed to the fixed handle 12 for movement therewith, a movable jaw 18 pivotally mounted to both the movable handle 14 and the fixed handle 12, and apparatus 20 for holding a chain 22 and being associated with detents 21 in both the fixed jaw 16 and the movable jaw 18, respectively.

(7) U.S. Pat. No. 6,199,458 to Wrigley et al

U.S. Pat. No. 6,199,458 issued to Wrigley et al. on Mar. 13, 2001 in class 81 and subclass 319 teaches a pair of locking pliers including a first assembly defining a first handle and a first jaw, a second handle, and a second jaw rotatably coupled to the first assembly and the second handle. The second handle is movable relative to the first handle to move the second jaw relative to the first jaw. A lock and release mechanism have a first setting wherein the second jaw is freely movable relative to the first jaw, a second setting wherein the second jaw locks at a preset distance from the first jaw when the second handle is moved toward the first handle, and a third setting wherein the second jaw unlocks when the second handle is moved toward the first handle.

2. SUMMARY OF THE INVENTION

Thus, an object of the embodiments of the present invention is to provide locking pliers for detachably lockingly capturing a chain thereto.

Briefly stated, another object of the embodiments of the present invention is to provide an improved chain locking pliers being of the type having a fixed handle, a movable handle, a fixed jaw affixed to the fixed handle for movement therewith, a movable jaw pivotally mounted to both the movable handle and the fixed handle, and apparatus for holding a chain and being associated with detents in both the fixed jaw and the movable jaw, respectively. The improvement includes the apparatus detachably lockingly capturing the chain to the fixed jaw.

3. BRIEF DESCRIPTION OF THE DRAWING

The figures on the drawing are briefly described as follows.

4. LIST OF REFERENCE NUMERALS UTILIZED IN THE DRAWING

Figure 1:
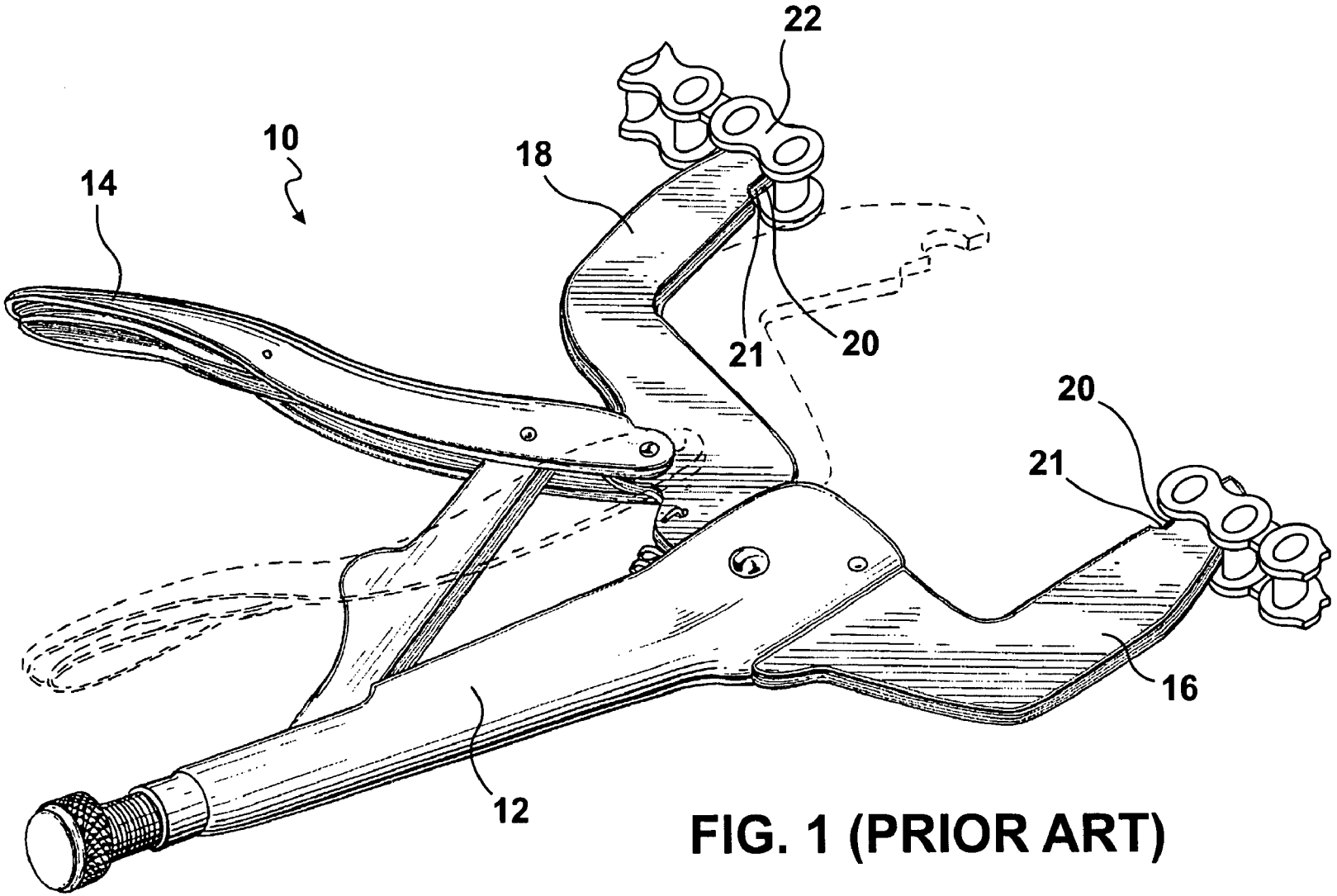
FIG. 1 (PRIOR ART)
FIG. 1 is diagrammatic perspective view of a typical prior art chain locking pliers.

A. Prior art.
10 typical prior art chain locking pliers
12 fixed handle
14 movable handle
16 fixed jaw
18 movable jaw
20 apparatus for holding chain 22
21 detents in both fixed jaw 16 and movable jaw 18, respectively
22 chain
B. General.
30 locking pliers of present invention for detachably lockingly capturing chain 22 thereto
C. Improvements.
(1) Apparatus 20.

-continued 42 spring-loaded clip for detachably lockingly capturing chain 22 in detent 21 in fixed jaw 16
44 spring of spring-loaded clip 42

5. DETAILED DESCRIPTION OF THE PREFERRED EMBODIMENTS

A. General

Figure 2:
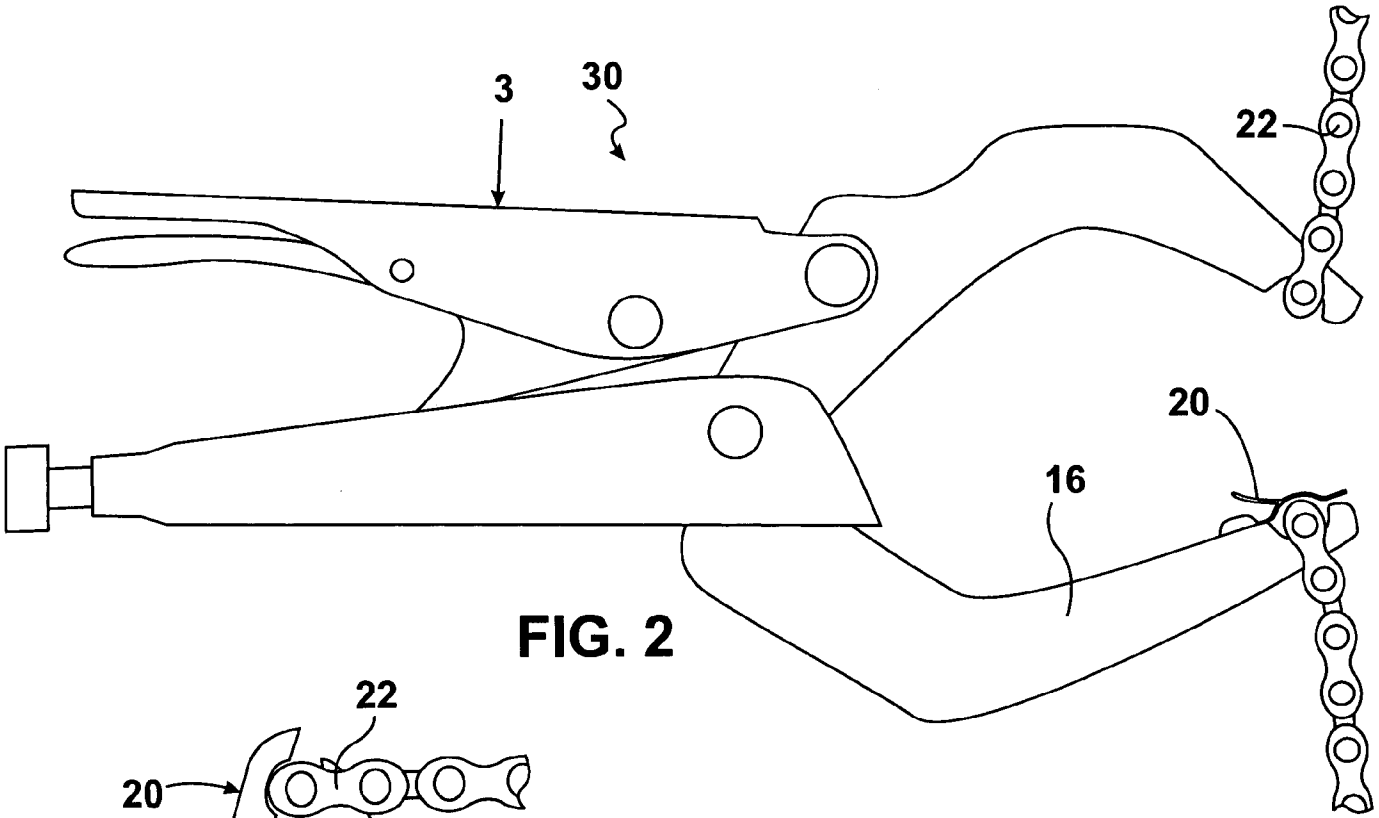
FIG. 2 is a diagrammatic top plan view of the locking pliers of the embodiments of the present invention detachably lockingly capturing a chain thereto.

Referring now to the drawings, in which like numerals indicate like parts, and particularly to FIG. 2, which is a diagrammatic top plan view of the locking pliers of the embodiments of the present invention detachably lockingly capturing a chain thereto, the locking pliers of the present invention is shown generally at 30 for detachably lockingly capturing the chain 22 thereto.

B. The improvements

The improvement comprises the apparatus 20 detachably lockingly capturing the chain 22 to the fixed jaw 16.

(1) The apparatus 20

Figure 3:
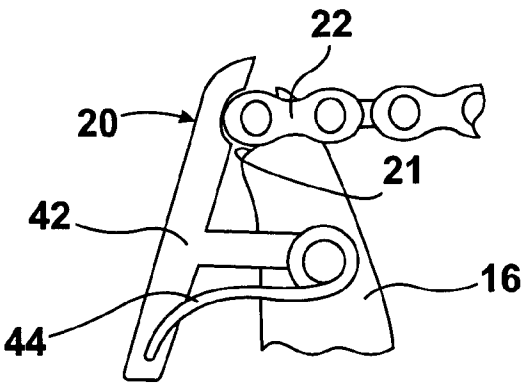
FIG. 3 is an enlarged diagrammatic side elevational view taken generally in the direction of ARROW 3 in FIG. 2 of the chain attaching apparatus of the embodiments of the locking pliers of the present invention.

The configuration of the apparatus 20 can best be seen in FIG. 3, which is an enlarged diagrammatic side elevational view taken generally in the direction of ARROW 3 in FIG. 2 of the chain attaching apparatus of the embodiments of the locking pliers of the present invention, and as such, will be discussed with reference thereto.

The improvement further comprises the apparatus 20 comprising a spring-loaded clip 42 pivotally mounted to the fixed jaw 16 for detachably lockingly capturing the chain 22 in the detent 21 in the fixed jaw 16.

The improvement further comprises the spring-loaded clip 42 comprises a spring 44. The spring 44 of the spring-loaded clip 42 is one of a tension spring and a coil spring.

The invention claimed is:

1. An improved chain locking pliers of the type having a fixed handle, a movable handle, a fixed jaw affixed to the fixed handle for movement therewith, a movable jaw pivotally mounted to both the movable handle and the fixed handle, and apparatus for holding a chain and being associated with detents in both the fixed jaw and the movable jaw, respectively, said improvement comprising:
the apparatus detachably lockingly capturing the chain to the fixed jaw and comprising a spring-loaded clip.

2. The improved pliers of claim 1, wherein said improvement comprises said spring-loaded clip being pivotally mounted to the fixed jaw for detachably lockingly capturing the chain in the detent in the fixed jaw.

3. The improved pliers of claim 1, wherein said improvement comprises said spring of said spring-loaded clip is one of a tension spring and a coil spring.

* * * * *